United States Patent [19]

Gorgone et al.

[11] 4,418,824

[45] Dec. 6, 1983

[54] DUAL STACKER FOR SLOT ACCEPTOR

[75] Inventors: Robert L. Gorgone, Mentor; Anthony H. Dolejs, Bedford Heights, both of Ohio

[73] Assignee: Ardac, Inc., Eastlake, Ohio

[21] Appl. No.: 281,326

[22] Filed: Jul. 8, 1981

[51] Int. Cl.[3] ..... B07C 5/36; B65H 31/06

[52] U.S. Cl. ..... 209/534; 271/181

[58] Field of Search ..... 209/534, 651, 653; 194/4 C, 4 E, 4 F, 4 G, 4 R; 271/181, 279, 303

[56] References Cited

U.S. PATENT DOCUMENTS

| | | | |
|---|---|---|---|
| 3,266,798 | 8/1966 | Bleiman | 271/181 X |
| 3,655,186 | 4/1972 | Bayha | 194/4 E X |
| 3,917,260 | 11/1975 | Okkonen et al. | 271/181 |
| 4,011,931 | 3/1977 | Wyckoff | 209/534 X |

FOREIGN PATENT DOCUMENTS

| | | | |
|---|---|---|---|
| 626300 | 4/1963 | Belgium | 271/303 |
| 2453811 | 12/1980 | France | 194/4 C |

*Primary Examiner*—Robert B. Reeves
*Assistant Examiner*—Edward M. Wacyra
*Attorney, Agent, or Firm*—Oldham, Oldham, Hudak, Weber & Sand Co.

[57] ABSTRACT

A dual stacker for slot acceptors, capable of receiving and separately stacking securities of at least two denominations. The invention includes a receptacle beneath the note path of a slot acceptor. A punch plate is operative for reciprocating movement through such receptacle. On each side of the receptacle are stacking plates, one for each denomination of bill to be handled. When a bill is sensed as being valid, and a determination is made as to the denomination of the bill, the punch plate is appropriately positioned on one side of the receptacle or the other. The bill is then dropped into the receptacle and the punch plate passed therethrough to move the bill on to the appropriate stack. The invention also includes bill retaining bars to prevent the bills from springing outwardly from the stacks. These bars are removable for easy access to the stacks by an operator.

10 Claims, 24 Drawing Figures

3.65°
37.72°
90°
142.28°
13.385°
145.93°
35.24°
17.035°
72.965°
35.245°
20.88
17.03°

DUAL STACKER FOR SLOT ACCEPTOR

TECHNICAL FIELD

The invention herein resides in the art of security validation apparatus. More particularly, the invention relates to an assembly for use in what is known as a slot acceptor, to receive, separate, and stack at least two different classifications of securities. For example, when used as a currency validator, the apparatus functions to separately receive and store currencies of two denominations.

BACKGROUND ART

Heretofore in the art, numerous types of security validators have been known and used. Such validators are typically of the tray or slot acceptor types, the former receiving the currency or security into a tray which is then slid into a test position, while the latter receives such currency in a slot and then, by rollers or the like, passes the currency beyond the test station. In either assembly, once the currency or security has been validated and the determination has been made that goods and/or change is to be dispensed in exchange therefor, the currency must be retrieved and appropriately stored for future acquisition by the operator. Means for receiving and retaining such currency are typically referred to as stackers.

Of course, stackers have been previously known in the art and the same have been devised for both tray and slot acceptors. Indeed, known stackers operate on both a gravity feed and mechanically actuated concept. However, known stackers are not capable of efficiently performing in acceptors which are operative for testing and receiving currencies of multiple denominations. In many such acceptors, the multiple currencies are all received and stacked in the same location with the operator having to manually separate the various denominations. Of course, such a technique is extremely inefficient and time consuming. Additionally, in known stackers access to the stacked currency has generally been difficult. Finally, conceptions of stackers which maintain the bills vertically have been difficult to develop because of the tendency of such bills to break out of or spring sideways from the stack.

DISCLOSURE OF INVENTION

In light of the foregoing, it is an object of an aspect of the invention to provide a dual stacker for slot acceptors receiving and maintaining securities in an easily accessible manner.

Another object of an aspect of the invention is to provide a dual stacker for slot acceptors which is capable of accurately and reliably separating plural denominations of currency, maintaining such denominations separate and apart from each other.

A further object of an aspect of the invention is to provide a dual stacker for slot acceptors which includes means for restraining currency stacked thereby to prevent springing of such currency from the respective stacks.

An additional object of an aspect of the invention is to provide a dual stacker for slot acceptors which utilizes a punch which is reversibly driven for efficiently moving currency of plural denominations to appropriate receiving stacks.

Yet another object of an aspect of the invention is to provide a dual stacker for slot acceptors which is reliable and efficient in operation, cost effective in construction, maintenance, and manufacture, and which is readily adaptable for use in existing state-of-the-art slot acceptors.

The foregoing and other objects of aspects of the invention which will become apparent as the detailed description proceeds are achieved by apparatus for receiving and storing notes of different denominations in a note acceptor, comprising: a receptable for temporarily receiving the notes; a punch reciprocatingly movable through said receptacle; and receiving means on either side of said receptacle, one for each denomination of note to be stored, for receiving notes moved by said punch from said receptacle.

BRIEF DESCRIPTION OF DRAWINGS

For a complete understanding of the objects, techniques, and structure of the invention, reference should be had to the following detailed description and accompanying drawings wherein:

FIGS. 6A–11C are illustrations of the interrelationship between the punch, punch drive assembly, and position photo sensors of the invention in each of the respective positions of interest.

BEST MODE FOR CARRYING OUT THE INVENTION

Figure 1:
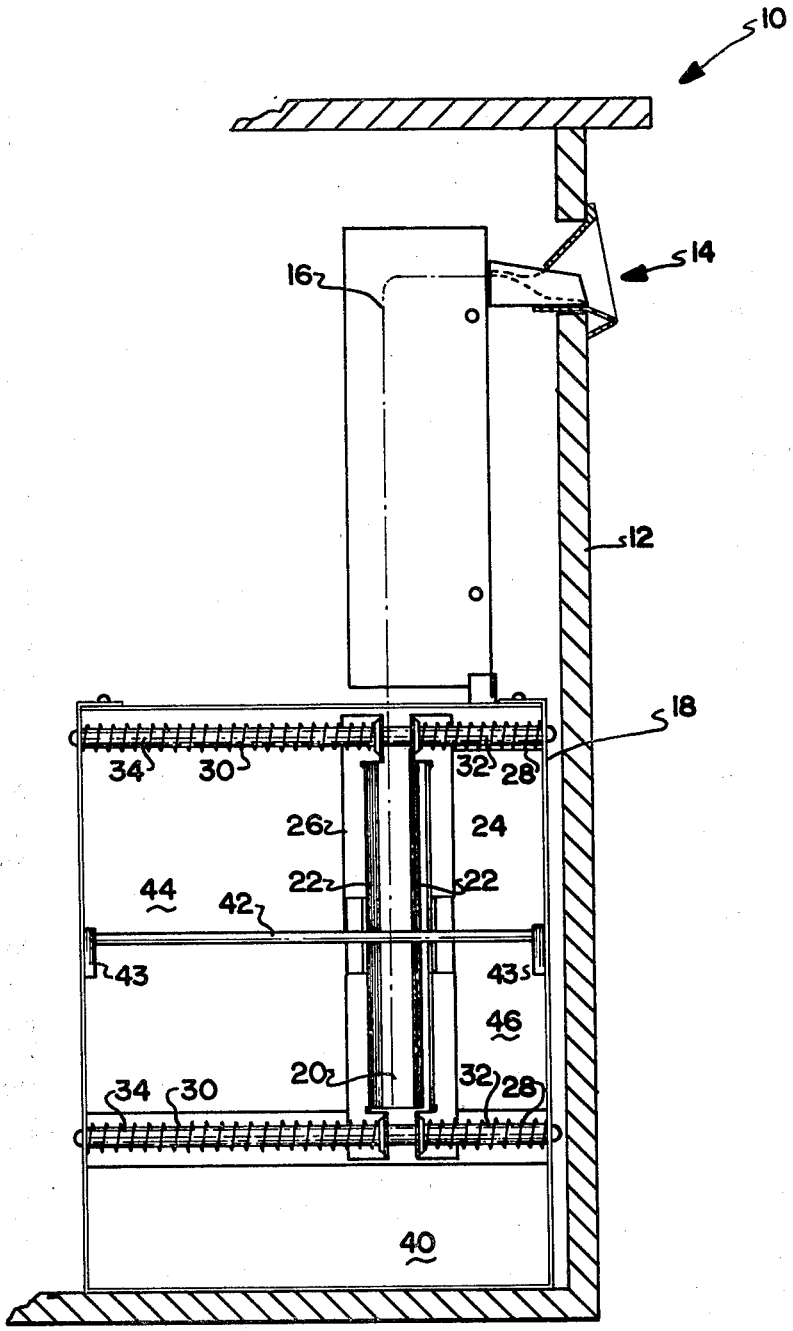
FIG. 1 is a side sectional view of the dual stacker of the invention.
Figure 2:
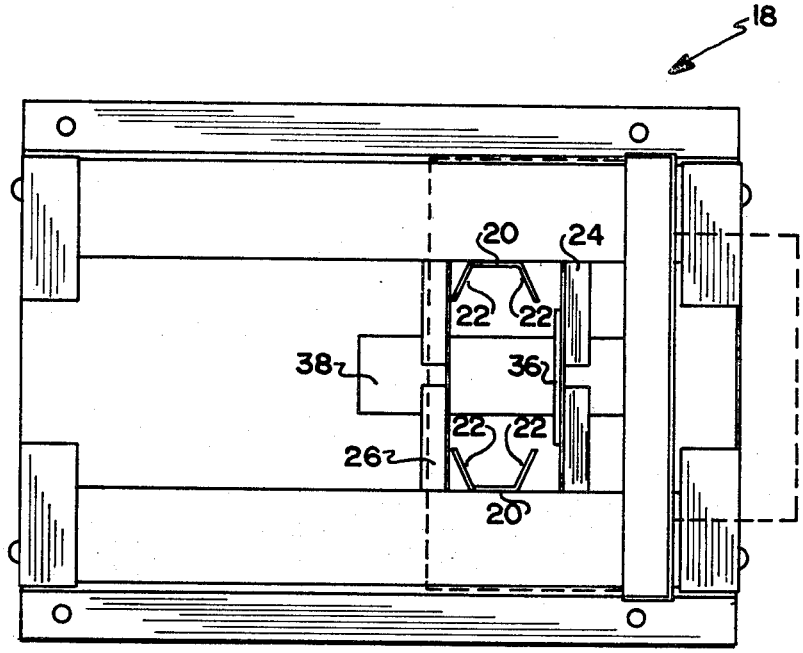
FIG. 2 is a top plan view of the stacker with the note acceptor assembly removed.

Referring now to the drawings and more particularly FIGS. 1 and 2, it can be seen that a note acceptor made in accordance with the teachings of the invention is designated generally by the numeral 10. The note acceptor, as best illustrated in FIG. 1, is of the slot acceptor type. The acceptor assembly includes a casing or cabinet 12, it being understood that the same is accessible in standard fashion by side access doors, opened by the operator through use of a key. As the name implies, the slot acceptor 10 includes a slot escutcheon 14 for receiving currency or other securities being tendered for validation. In standard fashion, a bill placed within the slot 14 travels along a note path 16 for ultimate receipt by the stacker assembly 18. The details of the slot acceptor are not set forth herein for such specifies are unimportant to the teachings of this invention. Suffice it to say that it is contemplated that such a slot acceptor may be of the type set forth in copending patent application Ser. No. 085,394, filed Oct. 16, 1979, for "SECURITY VALIDATOR", now U.S. Pat. No. 4,348,656, which issued on Sept. 7, 1982, and assigned to the assignee of the instant invention.

The stacker assembly 18 is also shown in top plan view in FIG. 2. As illustrated, the assembly 18 includes a pair of oppositely positioned plates 20, each having a pair of angled gate stops 22 extending therefrom. The plates and gate stops 20,22 define therebetween a temporary receptacle positioned beneath or at the end of the note path 16 for receiving a note once it has been determined that the same is valid and authentic. Maintained on each side of the plates 20 and biased into contacting engagement with the gate stops 22 are respective stacking plates 24,26. These stacking plates are biased by respective sets of springs 28,30, carried by associated rods 32,34. The biasing of the springs 28,30 urges the plates 24,26 toward contacting engagement with gate stops 22. It will, of course, be understood that each of the plates 24,26 has associated therewith pairs of upper and lower biasing springs.

A punch 36, comprising an appropriate plate or the like, is operative through an opening 38 to reciprocatingly transverse the receptacle defined between the pairs of plates 20,22. A motor and associated drive mechanism is maintained within a bottom section 40 of the cabinet 12 and will be discussed in detail hereinafter. Suffice it to say at this time that such mechanism achieves the desired movement of the punch 36 through the receptacle and into bill-stacking engagement with an appropriate stacking plate 24,26.

As will become apparent hereinafter, when a bill is received by the receptacle between the plates 20,22, the punch 36 directs the bill toward one of the stacking plates 24,26, each such stacking plate being associated with a particular denomination of the bill. The punch 36 moves the bill past the gate stops 22 with the bill deflecting as it moves thereacross and then into contacting engagement with previous bills which have been stacked on the appropriate stacking plate 24 or 26. The punch 36 then returns to a neutral position in line with one of the pairs of edges of the gate stops 22 such that these edges then hold the stack of bills against the plate 24,26. This urging of the stacks of bills between the plates 24,26 and the associated edges of the gates 22 is by virtue of the biasing of the springs 28,30 discussed above. It should be appreciated that the bills are thus stacked vertically, reducing the space required for the stacker assembly, and obviating the need for changing the posture of the bills as they are received from the note path 16.

It should now be apparent that the stacker 18 is divided into two sections 44,46, one section for each of two denominations of bills. For example, if the acceptor 10 were capable of receiving currency in one and five dollar denominations, the area 46 may be designated as that to receive the five dollar bills with the area 44 being designated for receiving the one dollar bills. With the areas 44,46 being of different size, it is obvious that the larger one will be designated for receiving and stacking the bills most commonly used.

As the bills stack between the appropriate plate 24,26 and the edges of the gates 22, there is a tendency for the bills to spring outwardly from the stack by sliding upon each other due to the pressure applied by the biasing of the springs 28,30. To prevent such outward springing, bill retaining bars 42 are placed on each side of the stacker 18 and are removably maintained by appropriate clips 43 at each end thereof. The pair of rods 42 are positioned in spaced relationship approximately equal to the width of the notes to be accepted so as to keep such notes properly aligned and to restrict the springing action. By being removable from the clips 43, an operator may open either of the side doors of the unit 10, remove one of the bars 42 and make access to the stacks of bills for removal through the side of the stacker 18. The operator may also reach down into the stacks for removal of the currency as apparent from the illustration of FIG. 2. In any event, there are three easy modes of access that an operator may make to the stacked currencies.

Figure 3:
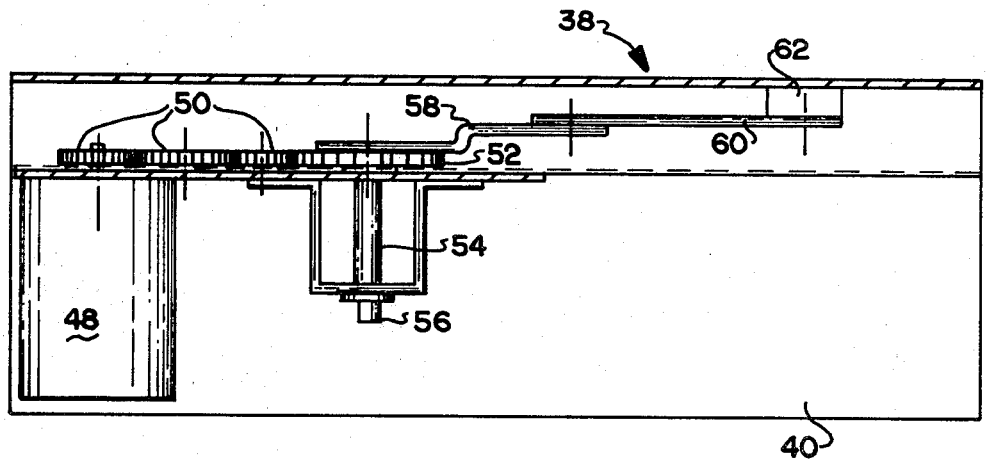
FIG. 3 is a side elevational view of the punch drive assembly of the invention.

With reference now to FIG. 3, an appreciation of the drive mechanism for the punch 36 may be obtained. Here it is illustrated that a reversible motor 48 is operative for driving a crank gear 52 through a gear train 50. The crank gear 52 is connected to a crank gear shaft 54 having an end 56 thereat for receiving interrupt position disks to be discussed hereinafter. A crank 58 is driven by the shaft 54 and is in pivotal driving interconnection with the punch link 60. With the end of the punch link 60 there is provided a punch slide 62 received within the opening 38 (best shown in FIG. 2) and guided thereby. The punch plate 36 is operatively connected to the punch slide 62. As can be seen, operation of the reversible servo motor 48 achieves movement of the punch plate 36 reciprocatingly within the opening 38 and transversing the receptacle defined by the plates 20,22. With the motor 48 being reversible, the shortest movement of the plate 36 to achieve the desired interaction with the stacking plate 24,26 may be obtained.

Figure 4:
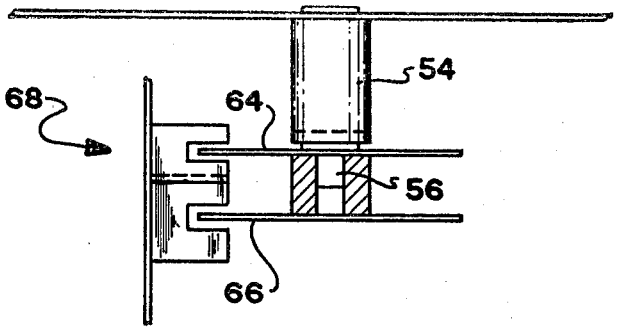
FIG. 4 is a side elevational view of the crank and punch position disks of the invention showing the same in operative interconnection between photo sensors and the crank gear shaft.
Figure 5:
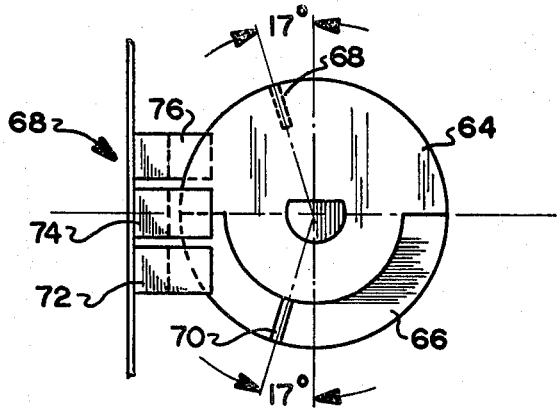
FIG. 5 is a top plan view of the structure of FIG. 4.

As illustrated in FIGS. 4 and 5, the end 56 of the crank gear shaft 54 receives thereon a crank position disk 64 and a punch position disk 66. The former disk 64, as illustrated, has an outer circumferential portion removed about an arc of 180 degrees. The punch position disk 66 is characterized by a pair of slots 68,70 passing therethrough. In a preferred embodiment of the invention, the slots are spaced apart by 146 degrees while each is spaced 17 degrees from the perpendicular intersect line of the 180 degrees sector removed from the plate 64. Of course, the particular spacings of the slots 68,70 and their position with respect to the half-moon shaped disk 64 will be dependent upon parameters including the spacings of the photo detector 72–76. It will be appreciated that the photo detectors 72,76 are interposed across the punch position disk 66, while the photo detector 74 is interposed across the crank position disk 64. In other words, an output signal from the photo detector 74 is emitted for a full half cycle of the rotation of the disk 64, indicating the half cycle position of the crank 58. The outputs of the photo detectors 72,76 result from sensing the slots 68,70 of the disk 66. These slots are spaced to indicate the position of the punch plate 36 at points when it is aligned with the edges of the gates 22.

Figure 5A:
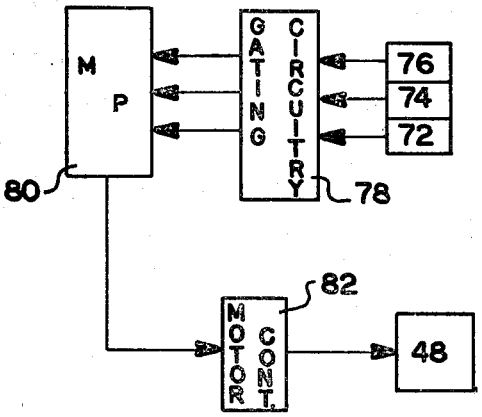
FIG. 5A is a schematic block diagram of the control circuitry of the invention.
Figures 6A, 6B, 6C, 7A, 7B, 7C, 8A, 8B, 8C, 9A, 9B, 9C, 10A, 10B, 10C, 11A, 11B, 11C:
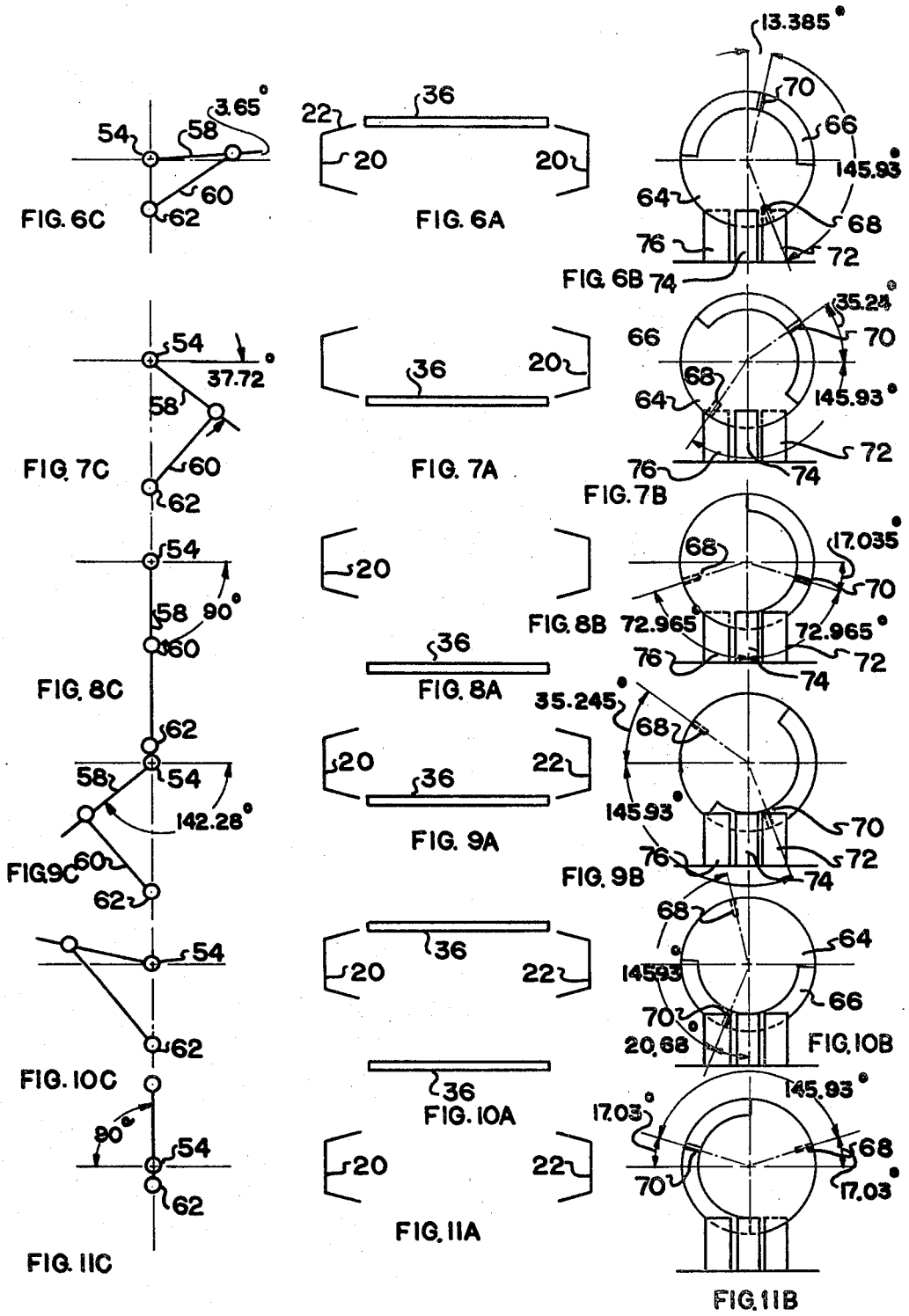

As shown in FIG. 5A, the outputs of the photo detectors or photo interrupts 72–76 are passed to gating circuitry 78 which is operative for buffering the outputs of the detectors 72–76, and raising the outputs to standard logic levels. These buffered outputs are then applied to the microprocessor 80 which is programmed to decode the outputs and determine therefrom the exact position of the punch plate 36. Through the motor control circuit 82, the microprocessor 80 may then control the reversible motor 48 to effect proper driving of the plate 36 to move bills from the receptacle defined by the plates 20 onto the appropriate stack.

As shown in FIGS. 6A–11C, the position of the punch plate 36 and its associated drive assembly 58,60 is related by the interaction of the crank position interrupt disk 64 and punch position interrupt disk 66 with respect to the photo detectors 72–76. FIGS. 6A–11C proceed through the entire movement of the punch plate 36 in its entire reciprocating path, indicating that alignment of the slot 68 with the photo detector 72 provides an output signal to the microprocessor 80 that the punch plate 36 is in alignment with edges of the gate stops 22 on the one side of the receptacle between the plates 20. As the disks 64,66 continue to rotate clockwise, and the slot 68 comes into registration with the photo detector 76, the microprocessor is advised that the plate 36 is moved to the opposite edge of the receptacle defined by the plates 20. This is respectively illustrated in FIGS. 6 and 7. With continued clockwise rotation, when an edge of the disk 64 comes into registration with the photo detector 74, allowing light to be sensed, the microprocessor 80 is advised that the plate 36 has made its maximum extensive travel, having cleared gate stops 22 and stacked the bill.

The removed sector of the plate 64 indicates via the photo detector 74 that the plate 36 is on its return half cycle. As rotation continues in a clockwise manner and as shown in FIG. 9, the plate moves until it is again in alignment with the same side of the plates 20 as illustrated in FIG. 7. At this time, the slot 70 indicates to the microprocessor 80 via the photo detector 72 that alignment has been made. If clockwise rotation were to continue until the slots 70 were sensed by the photo detectors 76, such would indicate that the punch plate 36 is in alignment with the side of the plates 20 illustrated in FIG. 10. It should be noted that this is the same position for the plate 36 as illustrated in FIG. 6. Finally, as shown in FIG. 11, as the plates continue their clockwise rotation, the plate 36 continues on to its maximum travel in a direction opposite that shown in FIG. 8, which situation is determined by blocking of the photo detector 74 by the plate 64. Continued clockwise rotation would then achieve the positioning shown in FIG. 6.

As can be seen, there is a monitoring of the position of the punch plate 36 as well as the crank arm assembly by means of the plates 64,66. In operation, the microprocessor 80 determines the validity of a note tendered and, if it is valid, it determines the position of the punch plate and the crank assembly to prepare the plate for stacking of the bill. While the bill is maintained in escrow by the note acceptor, the motor 48 is moved such that the punch plate 36 is on the opposite side of the receptacle defined by the plates 20 of the stack which is to receive that denomination of bill. Knowing the position of the crank assembly 58,60 and the punch plate 36, the microprocessor 80 drives the reversible motor 48 in the direction which most quickly attains the desired position. A microprocessor 20 then issues a vend signal, passing the note or bill down the note path 16 and into the receptacle between the plates 20. The motor 48 is then again actuated to cause the plate 36 to push the bill against the gate stops 22 and onto the proper stack. The plate 36 continues to move to its maximum extension of either FIGS. 8 and 11 and thence returns to the appropriate neutral position of either FIG. 6 or 9.

By utilizing the structure of the invention, the motor 48 may be prepared by the microprocessor 80 to receive and stack the currency once the validation test has been completed and while the currency is held in escrow. Hence, when the vend signal is issued, the bill is immediately received and stacked, making efficient use of time and operation. It will also be appreciated that with the motor 48 being reversible, the microprocessor 80 may prepare the position of the punch plate 36 with the least amount of rotational movement of the motor 48 and resultant movement of the crank assembly, again hastening the operation time.

Thus it can be seen that the objects of the invention have been satisfied by the structure presented hereinabove. While in accordance with the patent statutes only the best mode and preferred embodiment of the invention has been presented and described in detail, it is to be understood that the invention is not limited thereto or thereby. Accordingly, for an appreciation of the true scope and breadth of the invention, reference should be had to the appended claims.

What is claimed is:

1. Apparatus for receiving and storing notes of different denominations in a note acceptor, comprising:

a receptacle for temporarily receiving a note;

a punch reciprocatingly removable through said receptacle;

receiving means on either side of said receptacle, one for each denomination of note to be stored, for receiving notes moved by said punch from said receptacle; and position sensing means operatively connected to said punch for monitoring the positional relationship of said punch with respect to said receptacle, said position sensing means comprising photodetectors interconnected with said punch, said photodetectors sensing predetermined positions of said punch, and a pair of disks interposed between said photodetectors, said disks having openings therein in communication with said detectors.

2. The apparatus according to claim 1, wherein said receptacle comprises a pair of plates positioned opposite each other, each having diverging gate stops extending from side edges thereof.

3. The apparatus according to claim 1 which further includes control means connected to said punch for selectively positioning said punch on a selective side of said receptacle.

4. The apparatus according to claim 3, wherein said control means further drives said punch in said reciprocating movement.

5. Apparatus for receiving and storing bills, comprising:

a receptacle;

a pair of stacking means, one on each side of said receptacle;

a punch in reciprocal communication with said stacking means, said punch including a crank arm and drive linkage; and position sensing means operatively interconnected with said crank arm and drive linkage for monitoring the position of said punch with respect to said receptacle, said position sensing means comprising a pair of disks in intercommunication with a series of photodetectors, said photodetectors responding to positional indicia on said disks.

6. The apparatus as recited in claim 5 wherein said stacking means each comprises a spring biased plate.

7. The apparatus as recited in claim 6 wherein said punch comprises a plate in parallel relationship to said spring biased plate.

8. The apparatus according to claim 5 wherein said receptacle comprises a pair of oppositely positioned plates, each having diverging edges.

9. The apparatus according to claim 8 wherein each said stacking means comprises a plate biased toward contacting engagement with one of said edges of each of said oppositely positioned plates.

10. The apparatus according to claim 5 which further includes a reversible motor connected to and driving said punch.

* * * * *